US006187055B1

(12) United States Patent
Kottwitz et al.

(10) Patent No.: US 6,187,055 B1
(45) Date of Patent: Feb. 13, 2001

(54) WASHING AGENTS WITH SPECIFIC OXIDIZED OLIGOSACCHARIDES

(75) Inventors: Beatrix Kottwitz; Joerg Poethkow, both of Duesseldorf; Horst Upadek, Ratingen, all of (DE)

(73) Assignee: Henkel Kommanditgesellschaft auf Aktien, Duesseldorf (DE)

( * ) Notice: Under 35 U.S.C. 154(b), the term of this patent shall be extended for 0 days.

(21) Appl. No.: 09/091,979

(22) PCT Filed: Dec. 19, 1996

(86) PCT No.: PCT/EP96/05713

§ 371 Date: Aug. 3, 1998

§ 102(e) Date: Aug. 3, 1998

(87) PCT Pub. No.: WO97/25399

PCT Pub. Date: Jul. 17, 1997

(30) Foreign Application Priority Data

Jan. 3, 1996 (DE) ..... 196 00 018

(51) Int. Cl.[7] ..... C11D 3/22; D06L 3/00

(52) U.S. Cl. ..... 8/137; 510/302; 510/305; 510/367; 510/374; 510/375; 510/470; 510/471

(58) Field of Search ..... 510/302, 305, 510/367, 374, 375, 470, 471; 8/137

(56) References Cited

U.S. PATENT DOCUMENTS

| | | | | |
|---|---|---|---|---|
| 3,607,764 | * | 9/1971 | Crotty et al. | 510/174 |
| 3,873,614 | | 3/1975 | Lamberti et al. | 260/535 P |
| 4,001,133 | * | 1/1977 | Sorgenfrei et al. | 134/25.4 |
| 4,017,410 | * | 4/1977 | Sorgenfrei et al. | 510/219 |
| 4,390,451 | * | 6/1983 | Havinga et al. | 516/77 |
| 4,432,801 | * | 2/1984 | Tegiacchi et al. | 106/729 |
| 4,585,642 | | 4/1986 | Rieck | 423/333 |
| 4,602,086 | * | 7/1986 | Hiroshi et al. | 536/125 |
| 4,618,675 | * | 10/1986 | Lichtenthaler et al. | 536/17.2 |
| 4,664,839 | | 5/1987 | Rieck | 252/175 |
| 4,820,439 | | 4/1989 | Rieck | 252/135 |
| 4,985,553 | | 1/1991 | Fuertes et al. | 536/124 |
| 5,183,651 | | 2/1993 | Schimmel et al. | 423/334 |
| 5,229,095 | | 7/1993 | Schimmel et al. | 423/334 |
| 5,236,682 | | 8/1993 | Schimmel et al. | 423/334 |
| 5,268,156 | | 12/1993 | Schimmel et al. | 423/334 |
| 5,292,939 | * | 3/1994 | Hollingsworth | 562/515 |
| 5,308,596 | | 5/1994 | Kotzian et al. | 423/333 |
| 5,318,733 | | 6/1994 | Carduck et al. | 264/15 |
| 5,319,110 | * | 6/1994 | Hollingsworth | 549/313 |
| 5,346,680 | | 9/1994 | Roesler et al. | 423/274 |
| 5,356,607 | | 10/1994 | Just | 423/334 |
| 5,374,773 | * | 12/1994 | Hollingsworth | 562/515 |
| 5,382,377 | | 1/1995 | Raehse et al. | 252/174 |
| 5,417,951 | | 5/1995 | Just | 423/334 |
| 5,445,755 | * | 8/1995 | Convents et al. | 510/305 |
| 5,454,981 | * | 10/1995 | Murch et al. | 510/350 |
| 5,494,488 | | 2/1996 | Arnoldi et al. | 8/137 |
| 5,494,602 | * | 2/1996 | Thomaides et al. | 510/417 |
| 5,501,814 | | 3/1996 | Engelskirchen et al. | 252/174.17 |
| 5,505,875 | | 4/1996 | Beaujean et al. | 525/186.27 |
| 5,541,316 | | 7/1996 | Engelskirchen et al. | 510/471 |
| 5,560,896 | | 10/1996 | Bewersdorf et al. | 423/415.2 |
| 5,580,941 | | 12/1996 | Krause et al. | 527/300 |
| 5,658,873 | | 8/1997 | Bertsch-Frank et al. | 510/375 |
| 5,700,771 | * | 12/1997 | Hardy et al. | 510/315 |
| 5,853,430 | * | 12/1998 | Shindo et al. | 8/137 |

FOREIGN PATENT DOCUMENTS

| | | |
|---|---|---|
| 1 036 455 | 8/1978 | (CA) . |
| 24 12 837 | 10/1974 | (DE) . |
| 25 21 133 | 11/1976 | (DE) . |
| 42 21 381 | 2/1994 | (DE) . |
| 42 28 786 | 3/1994 | (DE) . |
| 43 00 772 | 7/1994 | (DE) . |
| 43 03 320 | 8/1994 | (DE) . |
| 44 17 734 | 11/1995 | (DE) . |
| 44 43 177 | 6/1996 | (DE) . |
| 0 164 514 | 12/1985 | (EP) . |
| 0 164 552 | 12/1985 | (EP) . |
| 0 232 202 | 8/1987 | (EP) . |
| 0 294 753 | 12/1988 | (EP) . |
| 0 425 427 | 5/1991 | (EP) . |
| 0 425 428 | 5/1991 | (EP) . |
| 0 436 835 | 7/1991 | (EP) . |
| 0 459 625 | 12/1991 | (EP) . |
| 0 486 592 | 5/1992 | (EP) . |
| 0 487 256 | 5/1992 | (EP) . |
| 0 502 325 | 9/1992 | (EP) . |
| 0 548 599 | 6/1993 | (EP) . |
| 0 567 140 | 10/1993 | (EP) . |
| 0 592 969 | 4/1994 | (EP) . |
| 0 623 553 | 11/1994 | (EP) . |
| 4/238 809 | 8/1992 | (JP) . |
| 4/260 610 | 9/1992 | (JP) . |
| 94 58592 | 8/1999 | (SU) . |
| WO91/08171 | 6/1991 | (WO) . |
| WO91/15423 | 10/1991 | (WO) . |
| WO92/11347 | 7/1992 | (WO) . |
| WO92/17400 | 10/1992 | (WO) . |
| WO92/17404 | 10/1992 | (WO) . |
| WO92/18542 | 10/1992 | (WO) . |
| WO93/04982 | 3/1993 | (WO) . |
| WO93/04159 | 4/1993 | (WO) . |
| WO93/16110 | 8/1993 | (WO) . |
| WO93/20007 | 10/1993 | (WO) . |
| WO94/03553 | 2/1994 | (WO) . |
| WO94/05594 | 4/1994 | (WO) . |
| WO94/14701 | 7/1994 | (WO) . |
| WO94/14702 | 7/1994 | (WO) . |

(List continued on next page.)

*Primary Examiner*—Mark Kopec
*Assistant Examiner*—Brian P. Mruk
(74) *Attorney, Agent, or Firm*—Wayne C. Jaeschke; Thomas F. Roland; Glenn E. J. Murphy

(57) ABSTRACT

A detergent composition containing surfactant, builder component, oxygen-based bleaching agent, bleach activator, and enzyme, wherein the builder component is an oxidatively modified oligosaccharide which contains a —COOH group instead of a —CH(OH)—CHO group at its originally reducing end group and which has an average degree of oligomerization of from 2 to 20.

13 Claims, No Drawings

FOREIGN PATENT DOCUMENTS

| | | |
|---|---|---|
| WO94/23005 | 10/1994 | (WO) . |
| WO94/24044 | 10/1994 | (WO) . |
| WO95/02555 | 1/1995 | (WO) . |
| WO95/02672 | 1/1995 | (WO) . |
| WO95/06615 | 3/1995 | (WO) . |
| WO95/15291 | 6/1995 | (WO) . |
| WO95/15292 | 6/1995 | (WO) . |

* cited by examiner

WASHING AGENTS WITH SPECIFIC OXIDIZED OLIGOSACCHARIDES

BACKGROUND OF THE INVENTION

1. Field of the Invention

The invention relates to detergents which contain as their builder or co-builder component an oligosaccharide which has been modified at its reducing end in such a way, instead of a hydroxymethylene aldehyde unit, a carboxyl unit is present at that end.

2. Discussion of Related Art

In addition to surfactants essential to their cleaning performance, detergents normally contain so-called builders of which the function is to support the work of the surfactants by eliminating hardness salts, i.e. essentially calcium and magnesium ions, from the wash liquor so that they do not negatively interact with the surfactants. One well-known example of builders which improve single wash cycle performance is zeolite Na-A which is known to be capable of forming such stable complexes, particularly with calcium ions, that their reaction with anions responsible for water hardness, particularly carbonate, to form insoluble compounds is suppressed. Another function of builders, particularly in laundry detergents, is to prevent redeposition of the soil detached from the fibers or generally from the surface to be cleaned and also insoluble compounds formed by the reaction of hardness-forming cations with hardness-forming anions onto the cleaned textile or rather onto the surface. So-called co-builders, generally polymeric polycarboxylates, are normally used for this purpose. In addition to the contribution they make towards multiple wash cycle performance, co-builders advantageously have a complexing effect on the cations responsible for water hardness.

The present invention seeks to make a contribution towards the use of so-called biologically degradable builders, i.e. naturally occurring substances or minimally modified derivatives thereof which are assumed to have better degradabiltiy than synthetic polymers of unsaturated mono- and dicarboxylic acids.

DESCRIPTION OF THE INVENTION

The present invention relates to a detergent containing surfactant, inorganic builder, oxygen-based bleaching agent, bleach activator and/or enzyme, characterized in that it contains an oligosaccharide containing a —COOH group instead of a —CH(OH)—CHO group at its originally reducing end as the builder or co-builder component.

It is particularly surprising that an oxidatively modified oligosaccharide of the type in question should have a distinctly better redeposition-inhibiting effect under washing conditions than conventional acrylic acid/maleic acid copolymers for at least the same ash values and at least the same incrustation-inhibiting effect. Accordingly, the present invention also relates to the use of oligosaccharides containing a —COOH group instead of a —CH(OH)—CHO group at their originally reducing end as redeposition inhibitors in detergents and water-containing wash liquors for washing fabrics. The present invention also relates to a process for washing textiles in water-containing and, in particular, surfactant-containing liquors using the modified oligosaccharides mentioned as redeposition inhibitors.

The preferred monomer in the builder or co-builder to be used in accordance with the invention after oxidative modification is glucose. The average degree of oligomerization n, which—as an analytically determined quantity—may even be a broken number, is preferably in the range from 2 to 20 and more preferably in the range from 2 to 10.

The oligosaccharide used as builder or co-builder in accordance with the invention has been oxidatively modified with the loss of a carbon atom at its originally reducing end. If the originally reducing end of the oligosaccharide was an anhydroglucose unit, an arabonic acid unit is present after the modification:

$$(\text{glucose})_n \rightarrow (\text{glucose})_{n-1}\text{-arabonic acid.}$$

This oxidative modification may be carried out, for example, with Fe, Cu, Ag, Co or Ni catalysts, as described in International patent application WO 92/18542, with Pd, Pt, Rh or Os catalysts, as described in EP 0 232 202, or with a quinone/hydroquinone system in alkaline medium in the presence of oxygen, optionally followed by aftertreatment with hydrogen peroxide.

The oligosaccharide starting material modifiable by such oxidation processes is preferably an oligosaccharide with a dextrose equivalent (DE) of 20 to 50, the DE being a standard measure of the reducing effect of a polysaccharide by comparison with dextrose which has a DE of 100. Suitable polysaccharides are, in particular, so-called glucose sirups (DE 20–37) and dextrins which are both obtainable by partial hydrolysis of starch by conventional methods, for example by acid- or enzyme-catalyzed methods, and which may be used in the above-mentioned oxidation processes as such or in the form of higher polymers, for example in the form of starch, providing the polymer chain structure of the starch also undergoes corresponding degradation under the oxidation conditions.

The detergents according to the invention preferably contain 0.5% by weight to 10% by weight and more preferably 2% by weight to 7% by weight of the oxidatively modified oligosaccharide which is normally used in the form of its alkali metal salt. Concentrations of oxidatively modified oligosaccharide in the wash liquor of 0.001% by weight to 0.05% by weight are preferred both for the use according to the invention and for the washing process according to the invention.

In addition to the active substance used in accordance with the invention, the detergents according to the invention, which may be present in particular as particulate solids, pastes, homogeneous solutions or suspensions, may basically contain any known ingredients typically encountered in detergents. The detergents according to the invention may contain in particular surfactants, bleaching agents, bleach activators, water-miscible organic solvents, enzymes, additional builders, sequestering agents, electrolytes, pH regulators and other auxiliaries, such as optical brighteners, dye transfer inhibitors, foam regulators, abrasives and dyes and perfumes.

In one preferred embodiment, a detergent according to the invention contains a water-soluble and/or water-insoluble organic and/or inorganic (main) builder in addition to the oxidatively modified oligosaccharide. Builders are present in the detergents according to the invention in total quantities of preferably up to 60% by weight and, more preferably, from 5% by weight to 40% by weight.

Particularly suitable water-soluble inorganic builders are polyphosphates, preferably sodium triphosphate. Particularly suitable water-insoluble, water-dispersible inorganic builders are crystalline or amorphous alkali metal alumosilicates which are used in quantities of up to 50% by weight, preferably in quantities of not more than 40% by weight and—in liquid detergents in particular—in quantities of 1% by weight to 5% by weight. Of these crystalline or amorphous alkali metal alumosilicates, detergent-quality crystalline sodium alumosilicates, more particularly zeolite A, zeolite P and optionally zeolite X, are preferred. Quantities near the upper limit mentioned are preferably used in solid particulate detergents. Suitable alumosilicates in particular contain no particles larger than 30 $\mu$m in size, preferably at least 80% by weight consisting of particles less than 10 $\mu$m in size. Their calcium binding power, which may be determined in accordance with DE 24 12 837, is generally in the range from 100 to 200 mg CaO per gram.

Suitable substitutes or partial substitutes for the alumosilicate mentioned are crystalline alkali metal silicates which may be present either on their own or in admixture with amorphous silicates. The alkali metal silicates suitable for use as builders in the detergents according to the invention preferably have a molar ratio of alkali metal oxide to $SiO_2$ of less than 0.95:1 and, more particularly, from 1:1.1 to 1:12 and may be present in amorphous or crystalline form. Preferred alkali metal silicates are the sodium silicates, more particularly the amorphous sodium silicates, with a molar ratio of $Na_2O$ to $SiO_2$ of 1:2 to 1:2.8. Those with a molar ratio of $Na_2O$ to $SiO_2$ of 1:1.9 to 1:2.8 may be produced by the process according to European patent application EP 0 425 427. Preferred crystalline silicates, which may be used on their own or in admixture with amorphous silicates, are crystalline layer silicates with the general formula $Na_2Si_xO_{2x+1}\cdot yH_2O$, where x—the so-called modulus—is a number of 1.9 to 4 and y is a number of 0 to 20, preferred values for x being 2, 3 or 4. Crystalline layer silicates covered by this general formula are described, for example, in European patent application EP 0 164 514. Preferred crystalline layer silicates are those in which x in the above general formula assumes a value of 2 or 3. Both β- and δ-sodium disilicates ($Na_2Si_2O_5\cdot yH_2O$) are particularly preferred, β-sodium disilicate being obtainable for example by the process described in International patent application WO 91/08171. δ-Sodium silicates with a modulus of 1.9 to 3.2 may be produced in accordance with Japanese patent applications JP 04/238 809 and JP 04/260 610. Substantially water-free crystalline alkali metal silicates with the above general formula, in which x is a number of 1.9 to 2.1, obtainable from amorphous alkali metal silicates as described in European patent applications EP 0 548 559, EP 0 502 325 and EP 0 425,428, may also be used in detergents according to the invention. Another preferred embodiment of detergents according to the invention is characterized by the use of a crystalline sodium layer silicate with a modulus of 2 to 3 which may be obtained from sand and soda by the process according to European patent application EP 0 436 835. Crystalline sodium silicates with a modulus of 1.9 to 3.5 obtainable by the processes according to European patents EP 0 164 552 and/or EP 0 294,753 are used in another embodiment of detergents according to the invention. If an alkali metal alumosilicate, more particularly zeolite, is present as an additional builder, the ratio by weight of alumosilicate to silicate, expressed as water-free active substances, is preferably from 4:1 to 10:1. In detergents containing both amorphous and crystalline alkali metal silicates, the ratio by weight of amorphous alkali metal silicate to crystalline alkali metal silicate is preferably 1:2 to 2:1 and more preferably 1:1 to 2:1.

The water-soluble organic builders include aminopolycarboxylic acids, more particularly nitrilotriacetic acid and ethylenediamine tetraacetic acid; polyphosphonic acids, more particularly aminotris(methylene phosphonic acid), ethylenediamine tetrakis(methylene phosphonic acid) and 1-hydroxy-ethane-1,1-diphosphonic acid; polycarboxylic acids, more particularly citric acid and sugar acids, and polymeric (poly)carboxylic acids, more particularly the polycarboxylates obtainable by oxidation of polysaccharides according to International patent application WO 93/16110; polymeric acrylic acids, methacrylic acids, maleic acids and copolymers thereof which may also contain small amounts of polymerizable substances with no carboxylic acid functionality in copolymerized form. The relative molecular weight of the homopolymers of unsaturated carboxylic acids is generally in the range from 5,000 to 200,000 while the relative molecular weight of the copolymers is in the range from 2,000 to 200,000 and preferably in the range from 50,000 to 120,000, based on free acid. A particularly preferred acrylic acid/maleic acid copolymer has a relative molecular weight of 50,000 to 100,000. Suitable, but less preferred, compounds of this class are copolymers of acrylic acid or methacrylic acid with vinyl ethers, such as vinyl methyl ethers, vinyl esters, ethylene, propylene and styrene, in which the acid makes up at least 50% by weight. Other suitable water-soluble organic builders are terpolymers which contain two unsaturated acids and/or salts thereof as monomers and, as the third monomer, vinyl alcohol and/or a vinyl alcohol derivative or a carbohydrate. The first acidic monomer or its salt is derived from a monoethylenically unsaturated $C_{3-8}$ carboxylic acid and preferably from a $C_{3-4}$ monocarboxylic acid, more particularly from (meth)acrylic acid. The second acidic monomer or its salt may be a derivative of a $C_{4-8}$ dicarboxylic acid, preferably a $C_{4-8}$ dicarboxylic acid, maleic acid being particularly preferred. In this case, the third monomeric unit is formed by vinyl alcohol and/or by an esterified vinyl alcohol. Vinyl alcohol derivatives in which short-chain carboxylic acids, for example $C_{1-4}$ carboxylic acids, are esterified with vinyl alcohol are particularly preferred. Preferred terpolymers contain 60% by weight to 95% by weight and, more particularly, 70% by weight to 90% by weight of (meth) acrylic acid or (meth)acrylate, more particularly acrylic acid or acrylate, and maleic acid or maleate and 5% by weight to 40% by weight and preferably 10% by weight to 30% by weight of vinyl alcohol and/or vinyl acetate. Preferred terpolymers are those in which the ratio by weight of (meth)acrylic acid or (meth)acrylate to maleic acid or maleate is between 1:1 and 4:1, preferably between 2:1 and 3:1 and more preferably between 2:1 and 2.5:1. Both the quantities and the ratios by weight are based on the acids. The second acidic monomer or its salt may even be a derivative of an allyl sulfonic acid substituted in the 2-position by an alkyl group, preferably by a $C_{1-4}$ alkyl group, or by an aromatic radical preferably derived from benzene or benzene derivatives. Preferred terpolymers contain 40% by weight to 60% by weight and, more particularly, 45% by weight to 55% by weight of (meth)acrylic acid or (meth) acrylate, more preferably acrylic acid or acrylate, 10% by weight to 30% by weight and preferably 15% by weight to 25% by weight of methallyl sulfonic acid or methallyl sulfonate and, as third monomer, 15% by weight to 40% by weight and preferably 20% by weight to 40% by weight of a carbohydrate. This carbohydrate may be, for example, a monosaccharide, disaccharide, oligosaccharide or polysaccharide, monosaccharides, disaccharides or oligosaccharides being preferred. Of these, sucrose is particularly preferred. The use of the third monomer presumably introduces predetermined weak spots into the polymer which are responsible for its ready biodegradability. These terpolymers may be produced in particular by the processes described in German patent DE 42 21 381 and in German patent application DE 43 00 772 and generally have a relative molecular weight in the range from 1,000 to 200,000, preferably in the range from 200 to 50,000 and more preferably in the range from 3,000 to 10,000. Other copolymers are those described in German patent applications DE 43 03 320 and DE 44 17 734 which preferably contain acrolein and acrylic acid/acrylic acid salts or vinyl acetate as monomers. The organic builders may be used in the form of aqueous solutions, preferably 30 to 50% by weight aqueous solutions, above all for the production of liquid detergents. All the acids mentioned are generally used in the form of their water-soluble salts, more particularly alkali metal salts.

The use of oligosaccharides oxidatively modified as described above completely eliminates the need for such conventional organic co-builders without any adverse effect on the performance of the detergent. If desired, the conventional organic builders mentioned may be present in quantities of up to 5% by weight and, more particularly, in quantities of 1% by weight to 4% by weight. Quantities near the upper limit mentioned are preferably used in paste-form or liquid detergents according to the invention.

The detergents according to the invention may contain one or more surfactants, more particularly anionic surfactants, nonionic surfactants and mixtures thereof. Suitable nonionic surfactants are, in particular, alkyl glycosides and ethoxylation and/or propoxylation products of alkyl glycosides or linear or branched alcohols containing 12 to 18 carbon atoms in the alkyl moiety and 3 to 20 and preferably 4 to 10 alkyl ether groups. Corresponding ethoxylation and/or propoxylation products of N-alkylamines, vicinal diols, fatty acid esters and fatty acid amides, which correspond to the long-chain derivatives mentioned in regard to the alkyl moiety, and of alkylphenols containing 5 to 12 carbon atoms in the alkyl group may also be used.

Suitable anionic surfactants are, in particular, soaps and those containing sulfate or sulfonate groups with—preferably—alkali metal ions as cations. Preferred soaps are the alkali metal salts of saturated or unsaturated fatty acids containing 12 to 18 carbon atoms. These fatty acids need not even be completely neutralized. Suitable surfactants of the sulfate type include the salts of sulfuric acid semiesters of fatty alcohols containing 12 to 18 carbon atoms and the sulfation products of the above-mentioned nonionic surfactants with a low degree of ethoxylation. Suitable surfactants of the sulfonate type include linear alkyl benzenesulfonates containing 9 to 14 carbon atoms in the alkyl moiety, alkane sulfonates containing 12 to 18 carbon atoms, olefin sulfonates containing 12 to 18 carbon atoms, which are formed in the reaction of corresponding monoolefins with sulfur trioxide, and a-sulfofatty acid esters which are formed in the sulfonation of fatty acid methyl or ethyl esters.

Surfactants such as these are present in detergents according to the invention in quantities of preferably 5 to 50% by weight and, more preferably, 8 to 30% by weight. In dishwashing detergents according to the invention, however, they may be present in quantities below the lower limits mentioned. The surfactant content of dishwashing detergents is preferably from 0.1% by weight to 20% by weight and more preferably from 0.2% by weight to 5% by weight.

Suitable peroxygen-based bleaching agents which may be present in detergents according to the invention are, in particular, organic peracids, hydrogen peroxide and inorganic salts which yield hydrogen peroxide under washing conditions, such as perborate, percarbonate and/or persilicate. If solid peroxygen compounds are to be used, they may be employed in the form of powders or granules which may even be coated in known manner. If a detergent according to the invention contains peroxygen compounds, they are present in quantities of, preferably, 10% by weight to 30% by weight and, more preferably, 15% by weight to 25% by weight, sodium percarbonate being particularly preferred. It may be produced by known methods and, if desired, compounded in granular form or stabilized, as known for example from International patent applications WO 91/15423, WO 92/17400, WO 92/17404, WO 93/04159, WO 93/04982, WO 93/20007, WO 94/03553, WO 94/05594, WO 94/14701, WO 94/14702, WO 94/24044, WO 95/02555, WO 95/02672, WO 95/06615, WO 95/15291 or WO 95/15292. An alkali metal percarbonate stabilized with special borates, as known from European patent applications EP 459 625, EP 487 256 or EP 567 140, or an alkali metal percarbonate coated with a combination of alkali metal salts, as known from European patent applications EP 623 553 and EP 592 969, is preferably used.

The bleach activators optionally present in the detergents according to the invention include in particular compounds which form optionally substituted perbenzoic acid and/or peroxocarboxylic acids containing 1 to 10 carbon atoms and, more particularly, 2 to 4 carbon atoms under perhydrolysis conditions. Particularly suitable substances are those which contain O- and/or N-acyl groups with the number of carbon atoms mentioned and/or optionally substituted benzoyl groups. Preferred bleach activators are polyacylated alkylenediamines, more particularly tetraacetyl ethylenediamine (TAED), acylated glycolurils, more particularly tetraacetyl glycoluril (TAGU), acylated triazine derivatives, more particularly 1,5-diacetyl-2,4-dioxohexa-hydro-1,3,5-triazine (DADHT), acylated phenol sulfonates, more particularly nonanoyl or isononanoyl oxybenzenesulfonate, acylated polyhydric alcohols, more particularly triacetin, ethylene glycol diacetate and 2,5-diacetoxy-2,5-dihydrofuran, acetylated sorbitol and mannitol and acylated sugar derivatives, more particularly pentaacetyl glucose (PAG), pentaacetyl fructose, tetraacetyl xylose and octaacetyl lactose, and acetylated, optionally N-alkylated glucamine and gluconolactone. The bleach activator combinations known from German patent application DE 44 43 177 may also be used. Salts or complexes of transition metals, such as Mn, Co or Fe, may be used in addition to or instead of the bleach activators mentioned above.

Enzymes suitable for use in the detergents include those from the class of proteases, lipases, cutinases, amylases, pullulanases, hemicellulases, xylanases, cellulases, oxidases and peroxidases and mixtures thereof. Particularly suitable enzymes are those obtained from fungi or bacteria, such as *Bacillus subtilis, Bacillus licheniformis, Streptomyces griseus, Humicola lanuginosa, Humicola insolens, Pseudomonas pseudoalcaligenes* or *Pseudomonas cepacia*. The enzymes optionally used may be adsorbed onto supports and/or encapsulated in shell-forming substances to protect them against premature inactivation, as described in International patent applications WO 92/11347 or WO 94/23005. They are present in detergents according to the invention in quantities of preferably not more than 5% by weight and, preferably, between 0.2 and 2% by weight.

Organic solvents suitable for use in the detergents according to the invention, particularly where they are present in liquid or paste-like form, include alcohols containing 1 to 4 carbon atoms, more particularly methanol, ethanol, isopropanol and tert.butanol, diols containing 2 to 4 carbon atoms, more particularly ethylene glycol and propylene glycol, and mixtures thereof and the ethers derived from compounds belonging to the classes mentioned above. Water-miscible solvents such as these are present in the detergents and disinfectants according to the invention in quantities of preferably not more than 30% by weight and, more preferably, between 6% by weight and 20% by weight.

In order to establish a required pH value which is not self-adjusting through the mixing of the other components, the detergents according to the invention may contain system-compatible and environmentally compatible acids, more particularly citric acid, acetic acid, tartaric acid, malic acid, lactic acid, glycolic acid, succinic acid, glutaric acid and/or adipic acid, and also mineral acids, more particularly sulfuric acid, or bases, more particularly ammonium or alkali metal hydroxides. pH regulators such as these are present in the detergents according to the invention in quantities of preferably not more than 20% by weight and, more preferably, between 1% by weight and 17% by weight.

The detergents may additionally contain other ingredients typically encountered in detergents. These optional ingredients include in particular enzyme stabilizers, additional redeposition inhibitors, such as carboxymethyl cellulose, dye transfer inhibitors, for example polyvinyl pyrrolidone or polyvinyl pyridine-N-oxide, foam inhibitors, for example organopolysiloxanes or paraffins, and optical brighteners, for example stilbene disulfonic acid derivatives.

The production of solid detergents according to the invention does not involve any difficulties and may be carried out in known manner, for example by spray drying or granulation, enzymes, bleaching agents and any other heat-sensitive ingredients optionally being added separately at a later stage. To produce detergents according to the invention with a high bulk density, for example in the range from 650 g/l to 950 g/l, a process comprising an extrusion step as known from European patent EP 486 592 is preferably used. Liquid or paste-form detergents according to the invention in the form of solutions containing typical solvents are generally produced simply by mixing the ingredients which may be added to an automatic mixer either as such or in the form of solutions.

EXAMPLES

Example 1

Single Wash Cycle Performance

To a basic detergent BD containing 15% by weight of a 2:1 mixture of sodium alkyl benzenesulfonate and sodium fatty alkyl sulfate, 1% by weight of soap, 4% by weight of 5× ethoxylated $C_{12/18}$ alcohol, 25% by weight of zeolite Na-A, 16% by weight of sodium perborate monohydrate, 6% by weight of TAED and—to 100% by weight—enzyme granules, foam inhibitor granules, water and salts were added (based on the basic detergent) 5.5% by weight of oligosaccharide co-builder B1 oxidatively modified at its reducing end with an average degree of oligomerization of about 2.5 (D1), 5.5% by weight of oligosaccharide co-builder B2 oxidatively modified at its reducing end with an average degree of oligomerization of about 15 (D2) and—for comparison—5.5% by weight of maleic acid/acrylic acid copolymer (C1).

To determine single wash cycle performance, cotton fabrics soiled with dust/sebum (standardized test soil) were washed in a domestic washing machine (Miele® W914 Novotronic) at 90° C. (detergent dosage 105 g; water hardness 23° d). The reflectance values in % (determined using $Ba_2SO_4$ as white standard) are shown in Table 1 below as the result of double measurements. It was found that a detergent D1 or D2 according to the invention has slightly better single wash cycle performance than a detergent C1 containing only a conventional organic co-builder.

TABLE 1

Single wash cycle performance

| Detergent | Reflectance [%] |
|---|---|
| D1 | 78.2 |
| D2 | 77.4 |
| C1 | 76.5 |

Example 2

Determination of Multiple Wash Cycle Performance

Clean fabric samples were washed 25 times with detergents D1 and C1 under the conditions described in Example 1 and were then dried, weighed and reduced to ashes. After cooling, the ignition residue was reweighed. The resulting ash values, expressed in % of the original weight, are shown in Table 2 below. The initial value (unwashed fabric) is also shown for comparison.

TABLE 2

Ash values [%]

| | Ash [%] for fabric | | |
|---|---|---|---|
| Detergent | A | B | C |
| IV | 0.37 | 0.12 | 1.05 |
| D1 | 3.50 | 2.15 | 3.31 |
| C1 | 4.12 | 2.36 | 3.45 |

Fabric
A: WFK test fabric
B: bleached cotton cloth
C: terry

To determine incrustation, fabric samples washed as described above were weighed, boiled in a 5% EDTA solution with a liquor ratio of 1:20 (weighed fabric samples to EDTA solution) and then thoroughly rinsed several times with distilled water. The fabric samples were dried and reweighed. The difference in the weight of the samples before and after the treatment, expressed as a percentage of the original weight, represents the soluble incrustation.

The decrusted fabric samples were then reduced to ashes as described above. The values obtained represent the residual ash values (insoluble components). The test results are set out in Table 3 below.

TABLE 3

Incrustation and residual ash

| | Incrustation [%] for fabric | | Residual ash [%] for fabric | |
|---|---|---|---|---|
| Detergent | A | B | A | B |
| IV | 2.69 | 2.00 | 0.13 | 0.05 |
| D1 | 7.23 | 5.56 | 0.10 | 0.06 |
| V1 | 8.25 | 5.69 | 0.12 | 0.05 |

Fabric
A: WFK test fabric
B: bleached cotton cloth

The reflectance of the test fabrics washed 25 times with the particular detergent was determined as described in Example 1 to determine the discoloration of the fabrics caused by washing. The measured reflectance values (low values signify serious discoloration) are set out in Table 4 below as the mean values of double measurements.

TABLE 4

| | Discoloration [% reflectance] | | |
|---|---|---|---|
| | Fabric | | |
| Detergent | A | B | C |
| IV | 81.2 | 82.3 | 83.4 |
| D1 | 73.2 | 75.7 | 75.6 |
| C1 | 76.2 | 74.3 | 73.7 |

Fabric
A: WFT test fabric
B: bleached cotton cloth
C: terry

What is claimed is:

1. A detergent composition comprising surfactant, builder component, oxygen-based bleaching agent, bleach activator, and enzyme, wherein said builder component comprises an oxidatively modified oligosaccharide which contains a —COOH group instead of a —CH(OH)—CHO group at its originally reducing end group and which has an average degree of oligomerization of from 2 to 20.

2. A detergent composition as in claim 1 wherein said modified oligosaccharide has an average degree of oligomerization of from 2 to 10.

3. A detergent composition as in claim 1 wherein said originally reducing end group of the oligosaccharide has been replaced by an arabonic acid unit.

4. A detergent composition as in claim 1 containing from 0.5% by weight to 10% by weight of said oxidatively modified oligosaccharide, based on the weight of said composition.

5. A detergent composition as in claim 1 containing from 5% by weight to 40% by weight of builder, from 5% by weight to 50% by weight of surfactant, from 10% by weight to 30% by weight of oxygen-based bleaching agent, up to 5% by weight of enzyme and additionally, from 6% by weight to 20% by weight of water-miscible solvent, based on the weight of said detergent composition.

6. A detergent composition as in claim 1 containing from 0.1% by weight to 20% by weight of surfactant, based on the weight of said detergent composition.

7. The process of washing fabrics comprising contacting said fabrics with a wash liquor containing a detergent composition comprising surfactant, builder component, oxygen-based bleaching agent, bleach activator, and enzyme, wherein said builder component comprises an oxidatively modified oligosaccharide which contains a —COOH group instead of a —CH(OH)—CHO group at its originally reducing and group and which has an average degree of oligomerization of from 2 to 20.

8. A process as in claim 7 wherein said modified oligosaccharide has an average degree of oligomerization of from 2 to 10.

9. A process as in claim 7 wherein said originally reducing end group of the oligosaccharide has been replaced by an arabonic acid unit.

10. A process as in claim 7 wherein said detergent composition contains 0.5% by weight to 10% by weight of said oxidatively modified oligosaccharide, based on the weight of said composition.

11. A process as in claim 7 wherein said detergent composition contains from 5% by weight to 40% by weight of builder, from 5% by weight to 50% by weight of surfactant, from 10% by weight to 30% by weight of oxygen-based bleaching agent, up to 5% by weight of enzyme and additionally, from 6% by weight to 20% by weight of water-miscible solvent, based on the weight of said detergent composition.

12. A process as in claim 7 wherein said detergent composition contains from 0.1% by weight to 20% by weight of surfactant, based on the weight of said detergent composition.

13. A process as in claim 7 wherein said oxidatively modified oligosaccharide is present in said wash liquor in an amount of from 0.001% by weight to 0.05% by weight.

* * * * *